US005531348A

United States Patent [19]

Baker et al.

[11] Patent Number: 5,531,348

[45] Date of Patent: Jul. 2, 1996

[54] CHILD RESISTANT STEP-ON RECEPTACLE

[75] Inventors: Jeffrey J. Baker, Scotia; Philip Jaros, Gloversville, both of N.Y.

[73] Assignee: White Mop Wringer Company, Tampa, Fla.

[21] Appl. No.: 121,310

[22] Filed: Sep. 15, 1993

[51] Int. Cl.[6] ..... B65D 43/16; B65D 43/22

[52] U.S. Cl. ..... 220/264; 220/263; 220/318; 220/324; 220/908

[58] Field of Search ..... 220/262, 263, 220/264, 315, 318, 324, 908

[56] References Cited

U.S. PATENT DOCUMENTS

| | | | |
|---|---|---|---|
| 1,109,723 | 9/1914 | White | 220/262 |
| 1,251,984 | 1/1918 | Losoncy . | |
| 1,341,390 | 5/1920 | Snickers . | |
| 1,507,040 | 9/1924 | Zifferer | 220/263 |
| 1,948,413 | 2/1934 | Carola . | |
| 2,096,578 | 10/1937 | Flanagan | 220/262 |
| 2,351,597 | 6/1944 | Burlin | 220/262 |
| 2,551,043 | 5/1951 | Nystrom . | |
| 2,759,625 | 8/1956 | Ritter | 220/262 |
| 2,811,329 | 10/1957 | Press et al. | 220/263 |
| 2,910,206 | 10/1959 | Hodgson . | |
| 3,028,015 | 4/1962 | Williams . | |
| 3,347,507 | 10/1967 | Dyer . | |
| 5,048,712 | 9/1991 | Wolters | 220/262 |
| 5,163,574 | 11/1992 | Sosan | 220/262 |
| 5,170,904 | 12/1992 | Neuhaus | 220/262 |
| 5,249,693 | 10/1993 | Gillispie et al. | 220/262 |

FOREIGN PATENT DOCUMENTS

| | | | |
|---|---|---|---|
| 1080631 | 6/1954 | France | 220/262 |
| 592490 | 8/1934 | Germany . | |
| 2659017 | 6/1978 | Germany . | |
| 2065455 | 7/1981 | United Kingdom | 220/262 |

*Primary Examiner*—Gary E. Elkins
*Attorney, Agent, or Firm*—Fish & Neave; Robert R. Jackson

[57] ABSTRACT

A covered container having a step-on mechanism which allows "hands free" opening of the lid of the container by stepping on a foot pad. The step-on mechanism includes a safety mechanism which prevents opening of the lid of the container unless the safety mechanism is repositioned. The preferred embodiment includes a rotatable oblong member adjacent the foot pad. The oblong member is maintained in a vertical position to block downward movement of the foot pad. To open the lid of the container, the oblong member must be rotated so that its upper end is above the foot pad and both the oblong member and the foot pad may be depressed. It is not evident, at first glance, how to release the safety mechanism, thereby making the container relatively child-proof, and ideal for disposal of possibly harmful objects.

23 Claims, 4 Drawing Sheets

CHILD RESISTANT STEP-ON RECEPTACLE

BACKGROUND OF THE INVENTION

This invention relates to a receptacle having a step-on mechanism for opening the lid of the receptacle. More particularly, this invention relates to a safety latch mechanism which normally prevents opening of the lid of the receptacle, thereby preventing anyone unfamiliar with the safety latch mechanism, such as a child, from opening the receptacle.

Receptacles, such as waste disposal containers, having foot operated mechanisms that allow "hands free" opening of the receptacle's lid, are well known in the art. A simple embodiment has a foot pedal linked to a generally vertical bar, which, in turn, is linked to an end of the receptacle's lid. When the foot pedal is depressed, the vertical bar is pulled downward, lowering an end of the lid, and thereby opening the receptacle. A slightly more complex linkage mechanism allows more convenient frontal activation of the foot operated mechanism without interference by the vertical bar that lifts the lid. The latter embodiment has a generally horizontal bar (on which the foot pedal is located) pivotally linked to a first end of a generally vertical bar. The vertical bar is, in turn, pivotally linked at its second end to an end of the lid of the receptacle. The lid is hinged to the receptacle radially outwardly from the pivotal link with the vertical bar such that when the horizontal bar is depressed, the vertical bar is raised and the lid is tilted open.

The above-described foot operated containers are particularly useful in the medical field in which manual operation of an unsanitary container is undesirable. The convenience of easily stepping on a pedal to open a container, while one's hands may be occupied or needed for holding the object to be disposed also makes such containers popular and rather common in the medical field.

Nonetheless, the simplicity of foot-operated containers may be a disadvantage in inadequately supervised environments. Because such receptacles are so easy to open, and often are used to dispose of infectious waste, it may be possible for an unauthorized person to open such a receptacle and come into contact with the harmful contents. For example, in the absence of adequate supervision, a child may be able to open such a receptacle.

It therefore would be desirable to provide a safety latch mechanism on a covered container which locks the lid in a closed position to deter access to the contents of the container until the mechanism is released. Such a safety device should not be readily obvious so that young children would be unlikely to open the container, thereby making the container virtually child-proof.

SUMMARY OF THE INVENTION

It is therefore an object of this invention to provide a covered container having a foot-operated mechanism which allows for "hands free" opening of the container yet is child-proof—because the mechanism has a safety lock which must be activated in order to open the container.

It is a further object of this invention to provide a safety latch mechanism on a step-on container which not only prevents opening of the container by stepping on the foot pedal but also prevents opening of the container by manually lifting the lid of the container, until the mechanism is disabled.

These and other objects of the invention are accomplished in accordance with the principles of the invention by providing a linkage mechanism for foot-operated opening of a container, the linkage mechanism having a safety latch which locks the linkage mechanism to maintain the lid in a closed configuration. The safety latch is preferably located adjacent the foot pedal and is unlocked when stepped on so that the container remains foot-operated and "hands free." Moreover, the safety latch prevents relative movement between the links of the opening mechanism so that the container cannot be opened manually or by foot until the safety latch is moved to unlock the container.

Further features of the invention, its nature, and various advantages will be more apparent from the accompanying drawings (in which like reference characters represent like elements throughout) and the following detailed description of the preferred embodiments.

DETAILED DESCRIPTION OF THE PREFERRED EMBODIMENTS

Figure 1:
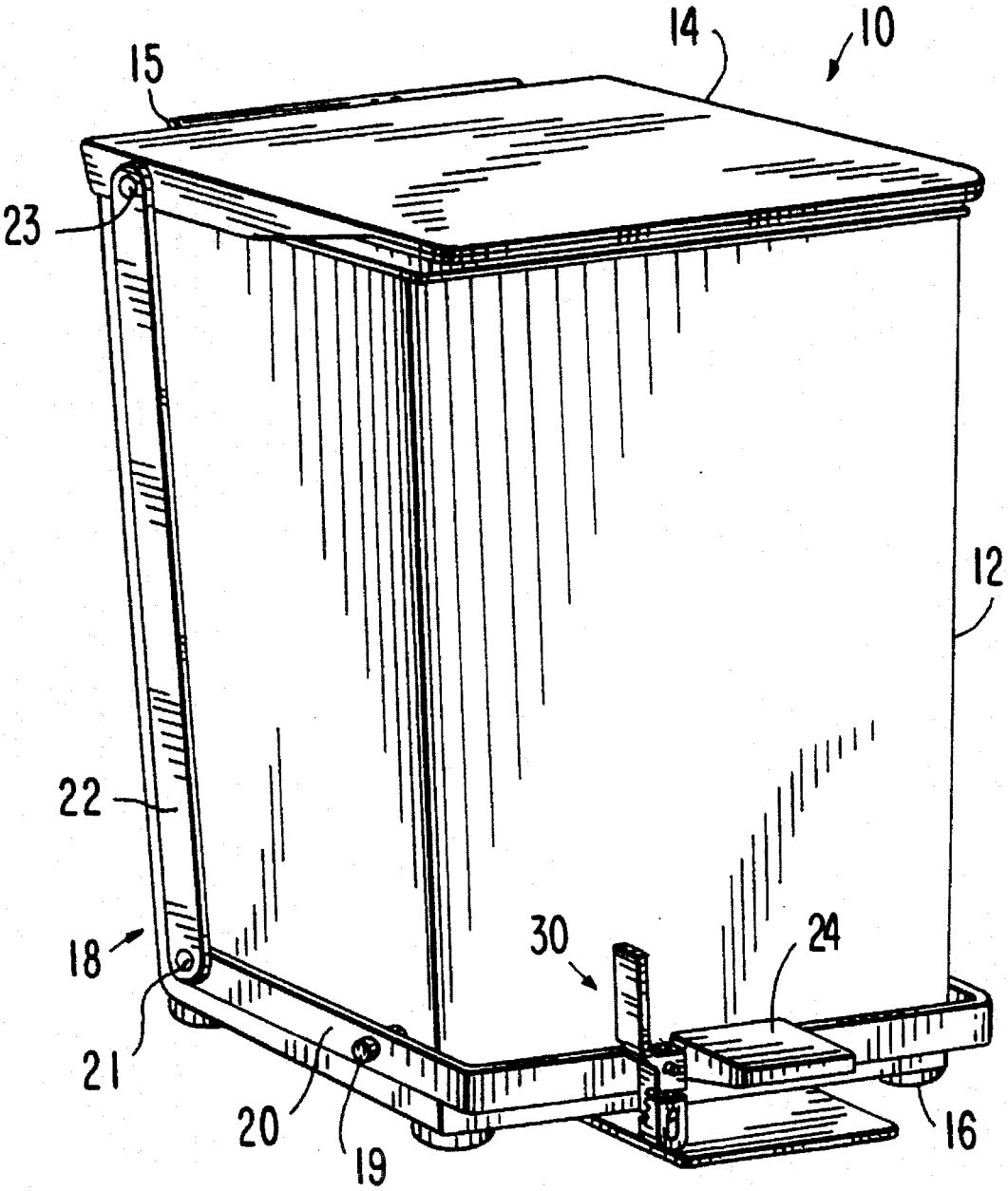
FIG. 1 is an isometric view of a step-on receptacle having a safety-mechanism, shown in position to maintain the lid of the receptacle in a closed configuration.
Figure 2:
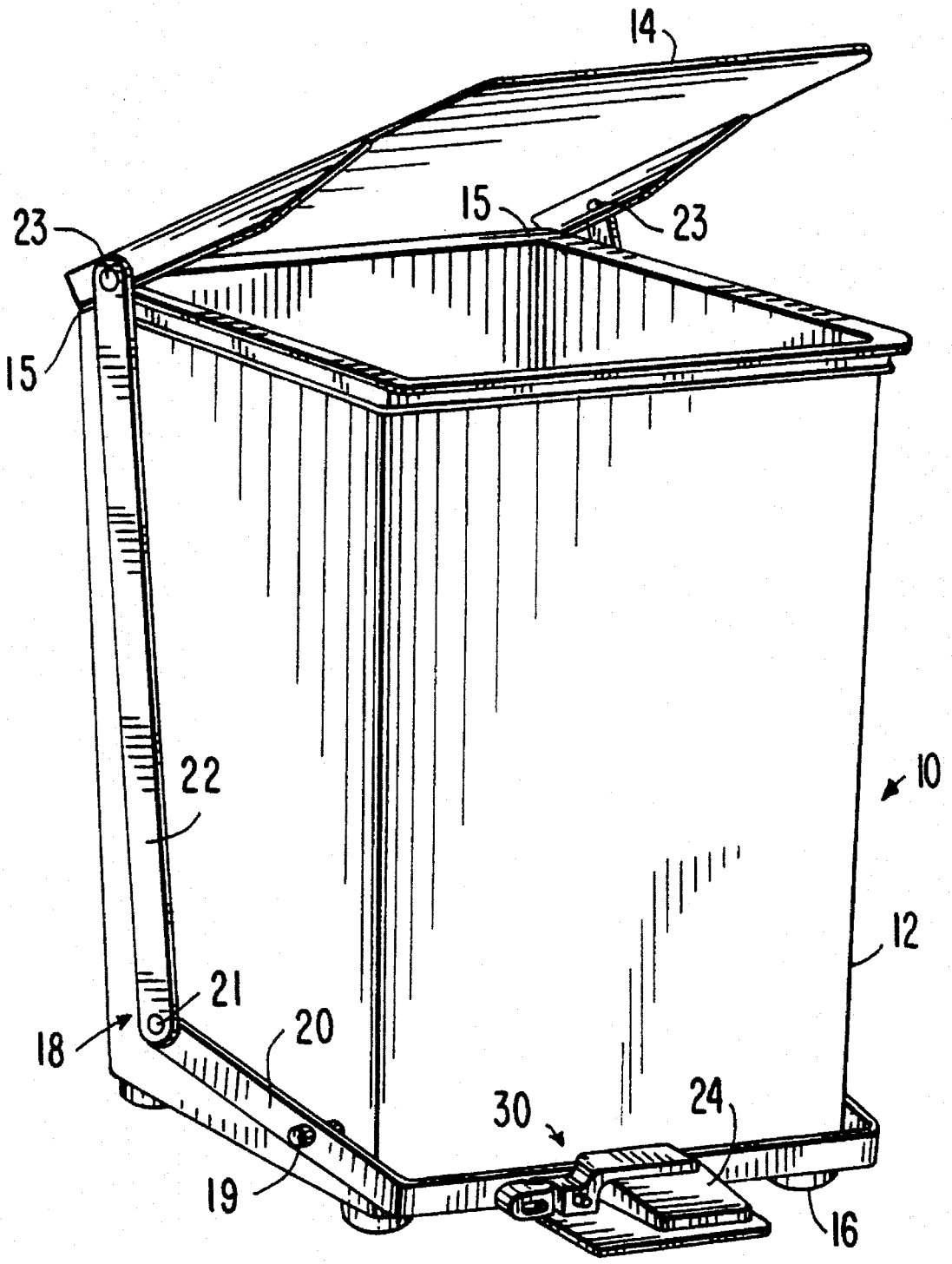
FIG. 2 iS an isometric view of the step-on receptacle of FIG. 1 with the safety-mechanism released and the foot pedal depressed to open the lid of the receptacle.

A child-proof container 10 constructed in accordance with the principles of this invention is shown in FIGS. 1 and 2, in open and closed configurations, respectively. Container 10 may be, for example, a waste container, and has a main receptacle 12 for holding waste, and a lid 14 for covering the open upper end of receptacle 12. Lid 14 is hinged at the back edge to the rear wall of receptacle 12 via hinge 15. Receptacle 12 preferably is slightly elevated above ground by feet 16, which preferably are made of rubber, to reduce the likelihood of container 10 scratching the floor on which container 10 is supported when container 10 is moved.

Linkage mechanism 18 provides a foot operated means for opening lid 14 without having to manually lift lid 14. Linkage mechanism 18 preferably includes at least a generally horizontal, preferably U-shaped link or bar 20 and a pair of generally vertical links or bars 22, one of each bars 22 being on each side of container 10. The base of U-shaped horizontal bar 20 is preferably positioned across the front of receptacle 12 with the legs of horizontal bar 20 extending along the sides of receptacle 12 towards the rear of receptacle 12. Horizontal bar 20 is pivotally pinned to receptacle 12 via pin or bolt 19 at a suitable location along each side of receptacle 12. At the ends of the legs of horizontal bar 20 closest to the rear side of receptacle 12, vertical bars 22 are pivotally freely connected to horizontal bar 20 via pins 21, only one of which is visible in the drawings. The opposite upper end of each vertical bar 22 is pivotally pinned to lid 14 via a pin or bolt 23. Pins 23 are positioned in front of hinge 15, closer to the front of container 10. Thus, when the base of U-shaped horizontal bar 20 (i.e., the portion extending across the front of receptacle 12) is lowered by, for example, stepping on foot pad/pedal 24, each end of U-shaped horizontal bar 20 adjacent a pin 21 is raised, thereby raising vertical bars 22 on both sides of container 10. The upper ends of vertical bars 22, adjacent pins 23, then tilt open lid 14, as shown in FIG. 2.

Figure 3:
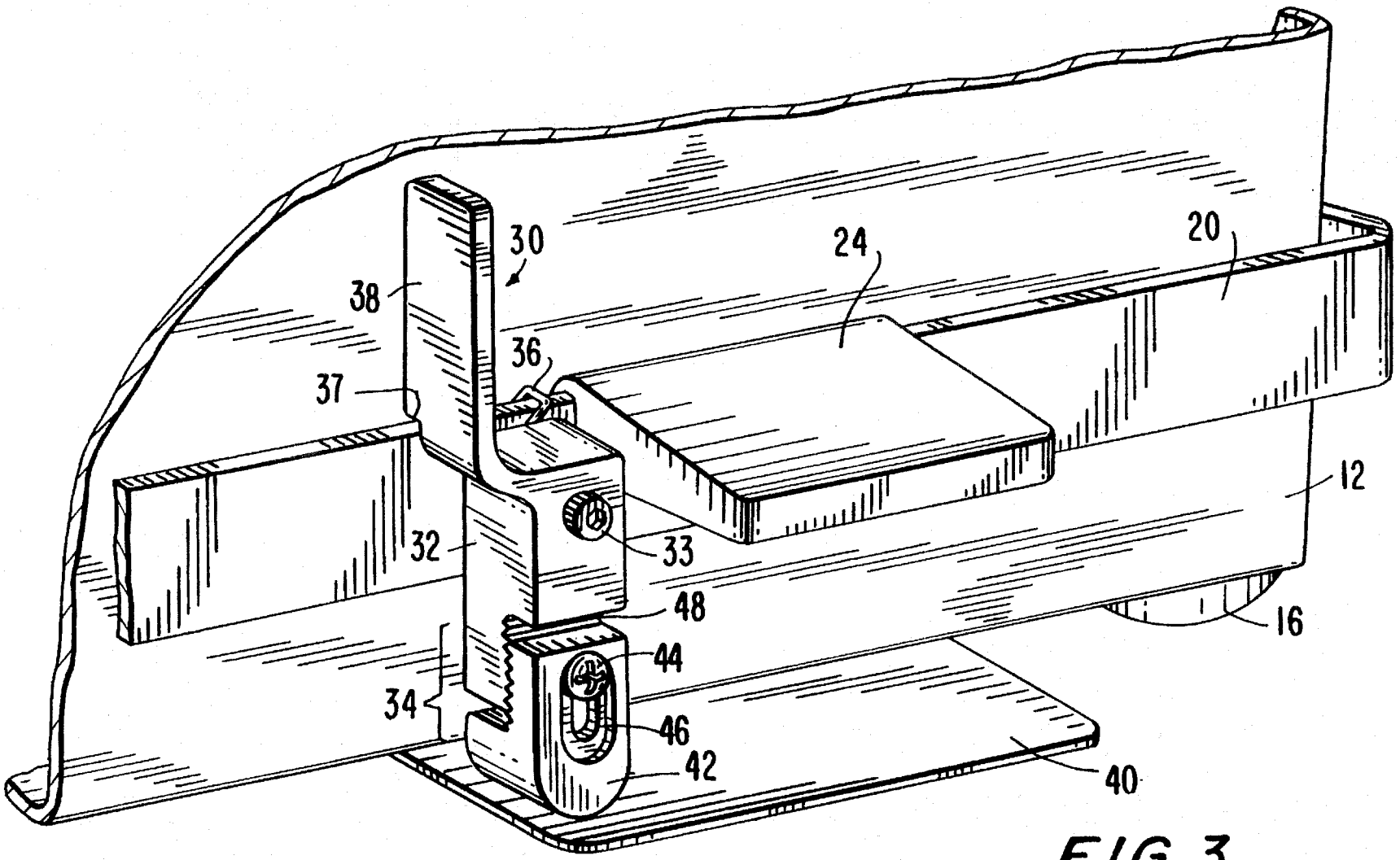
FIG. 3 is an isolated enlarged isometric view of the safety mechanism of the present invention, in the position shown in FIG. 1.
Figure 4:
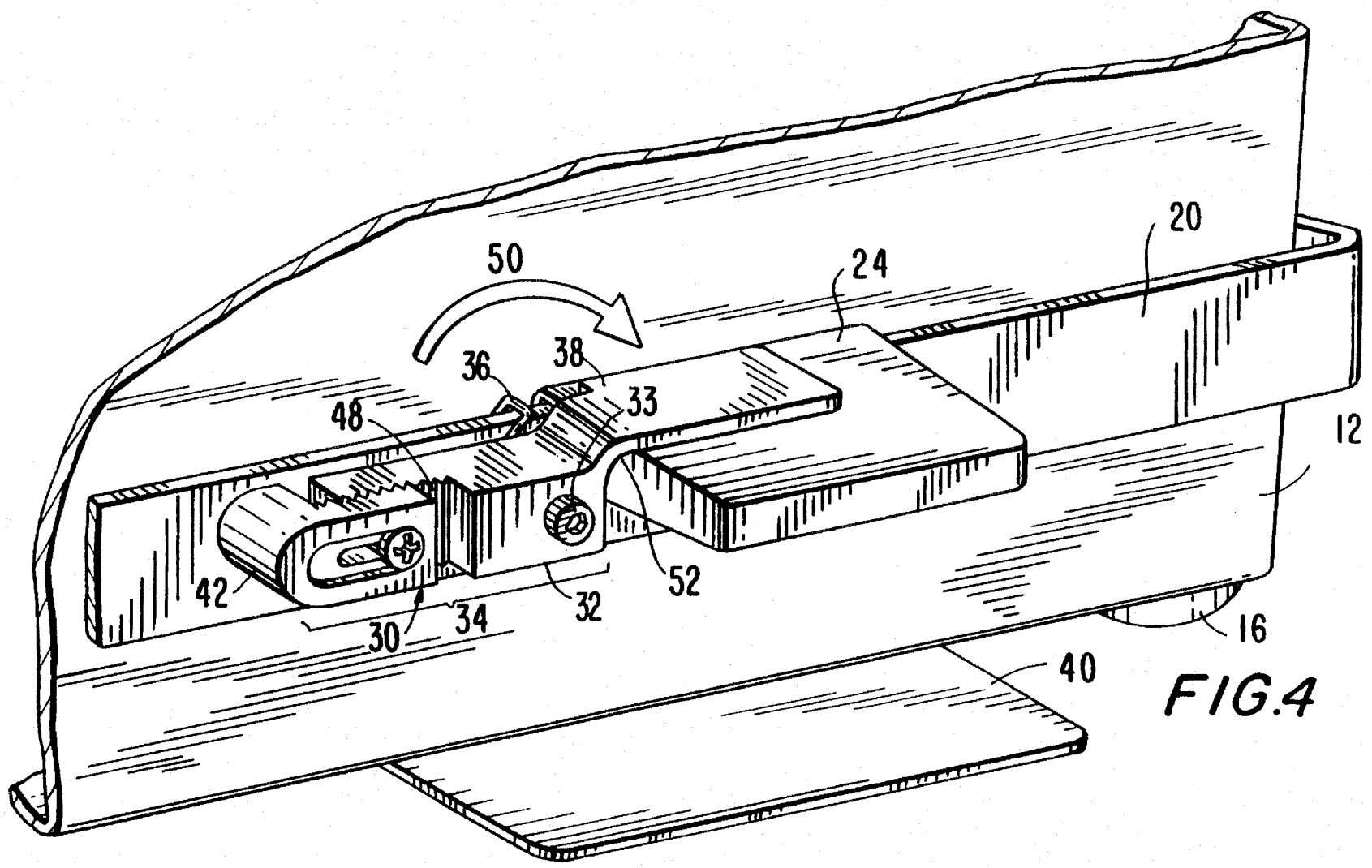
FIG. 4 is an isolated enlarged isometric view of the safety mechanism of the present invention, in the position shown in FIG. 2.

An important feature of container 10 is safety mechanism 30, associated with linkage mechanism 18, and shown in greater detail in FIGS. 3 and 4. Safety mechanism 30 has an elongated member 32 pivotally pinned to horizontal bar 20 with pin or bolt 33. As shown, safety mechanism 30 is positioned to the left of foot pad 24 and must be rotated to the right, in clockwise direction 50 (FIG. 4) in order to unlock container 10. It will be appreciated that safety mechanism 30 may, instead, be positioned to the right of foot pad 24 and rotated to the left, counterclockwise.

As shown in FIG. 3, elongated member 32 of safety mechanism 30 is substantially vertical when in the locked configuration. Lower end 34 of elongated member 32 occupies the space between horizontal bar 20 and the floor, thereby blocking downward movement of horizontal bar 20 and preventing lid 14 from opening.

Spring 36 (preferably a torsional spring) is positioned for the most part in a recess on the rear face of elongated member 32 and has a leg extending onto horizontal bar 20 to maintain elongated member 32 in the vertical, container-locking position. Shoulder 37, on the upper portion 38 of elongated member 32, prevents elongated member 32 from rotating too far to the left, counterclockwise (because of forces exerted by spring 36), thereby helping to maintain elongated member 32 in the vertical, container-locking position.

Although lower end 34 may rest against the surface on which container 10 is supported (e.g., the floor), it is preferable to include a floor plate 40 to protect the supporting surface. Floor plate 40 is connected to the bottom of receptacle 12 proximate to the location of safety mechanism 30. The distance between floor plate 40 and pin 33 should be approximately equal to the length of lower end 34 (i.e., the length of elongated member 32 from pin 33 to the free end of end 34).

As is evident from the proportions of linkage mechanism 18 and the position of pins 19 and 23, a slight downward movement of horizontal bar 20 will result in a fairly large movement of the front end of lid 14 upwards from the front wall of receptacle 12, opening container 10 fairly widely. In order to ensure that there is virtually no downward movement of horizontal bar 20 when safety mechanism 30 is in the container-locking position (FIGS. 1 and 3), the length of lower end 34 is preferably adjustable. Lower end 34 accordingly preferably includes an adjustable end portion 42 pinned with screw 44 to the lowermost free end of the main body of elongated member 32. Screw 44 slides in elongated aperture 46, preferably located in adjustable end portion 42. Adjustable end portion 42 and the lowermost end of the main body of elongated member 32 having corresponding interlocking corrugated surfaces 48 facing each other. In order to change the length of lower end 34, screw 44 is loosened, and adjustable end portion 42 is moved with respect to elongated member 32. Once the desired length is reached and corresponding corrugated surfaces 48 fit together, screw 44 is tightened. In this manner, any manufacturing variations affecting the security of the locked configuration may be accommodated by adjusting the length of lower end 34 to occupy the entire space between horizontal member 20 and floor plate 40 (or the supporting surface, if floor plate 40 is not included) to substantially completely prevent any downward movement of horizontal member 20.

When it is desired to open container 10, elongated member 32 of safety mechanism 30 is rotated by the foot of the user in direction 50, clockwise, as shown in FIG. 4. Upper end 38 preferably is slightly offset and has a curved surface 52 that accommodates foot pad 24, allowing elongated member 32 to be substantially parallel to foot pad 24, thereby increasing user comfort. The user must step on both upper end 38 and foot pad 24 in the correct way and in the correct sequence to depress horizontal bar 20 and open container 10.

It will be understood that the foregoing is merely illustrative of the principles of this invention, and that various modifications can be made by those skilled in the art without departing from the scope and spirit of the invention. For example, a different linkage mechanism configuration may be utilized. Likewise, the safety mechanism may be positioned in any other desired location which, in the rest position, would prevent relative movement between the bars of the linkage mechanism, and would be convenient to release when opening the container. It will be understood that the safety mechanism must be designed such that the manner of unlocking the container is not readily apparent. The described embodiments are presented for the purpose of illustration rather than limitation, and the present invention is limited only by the claims which follow.

What is claimed is:

1. A safety latch step-on container comprising:

a receptacle having a closed lower end and an open upper end;

a lid member covering said open upper end of said receptacle;

a linkage mechanism having a generally horizontal bar and a generally vertical bar, wherein said vertical bar is pivotally linked to said lid member and depressing said horizontal bar causes said vertical bar to move said lid member to open said container; and a safety mechanism coupled to said linkage mechanism and movable between a first position in which said safety mechanism prevents relative movement between said horizontal bar and said vertical bar to thereby lock said lid member down and keep said container closed, and a second position in which movement between said horizontal bar and said vertical bar is unrestricted so that said container is unlocked and may be opened.

2. The container defined in claim 1 further including means for releasably keeping said safety mechanism in said first position to maintain said container in a closed configuration.

3. The container defined in claim 2 wherein said means for releasably keeping said safety mechanism in said first position comprises a spring.

4. The container defined in claim 1 wherein said horizontal bar is adjacent said lower end of said receptacle and includes a foot pad on which a user steps to depress said horizontal bar.

5. The container defined in claim 1 wherein said safety mechanism is positioned on said horizontal bar to prevent downward movement of said horizontal bar and thereby maintain said container in a closed configuration.

6. The container defined in claim 5 wherein:

said safety mechanism comprises an oblong member having a center, said oblong member being rotatably connected to said horizontal member adjacent the center of said oblong member;

said oblong member is rotatable to a substantially vertical position when said safety mechanism is in said first position; and said oblong member is rotatable to a substantially horizontal position when said safety mechanism is in said second position.

7. The container defined in claim 6 further including a spring for maintaining said oblong member in said substantially vertical position.

8. The container defined in claim 7 further including means for preventing overrotation of said oblong member by forces exerted by said spring, said means for preventing overrotation functioning with said spring to maintain said oblong member in said substantially vertical position.

9. The container defined in claim 6 wherein said oblong member has a first lower end and a second upper end.

10. The container defined in claim 9 further including a floor plate positioned below said safety mechanism, wherein said first lower end of said oblong member rests on said floor plate when said oblong member is in said vertical position such that said floor plate prevents said safety mechanism and said horizontal member from being depressed.

11. The container defined in claim 10 wherein said floor plate is positioned on said lower end of said receptacle.

12. The container defined in claim 9 further including a foot pad on said horizontal member adjacent said safety mechanism, wherein said second upper end of said oblong member is positioned above said foot pad when rotated into said horizontal position, such that said container is opened by stepping on said second upper end of said oblong member, rotating said oblong member to said substantially horizontal position, and depressing both said oblong member and said horizontal bar.

13. The container defined in claim 12 wherein said second upper end of said oblong member has a curved portion shaped to accommodate said foot pad so that said foot pad does not interfere with rotation of said oblong member into a substantially horizontal position.

14. A mechanism for opening a lid of a receptacle, said mechanism comprising:

a linkage mechanism having a substantially horizontal bar and a substantially vertical bar; and a safety mechanism coupled to said linkage mechanism, said safety mechanism being movable between a first position in which said safety mechanism prevents relative movement between said horizontal bar and said vertical bar to thereby keep said container closed, and a second position in which movement between said horizontal bar and said vertical bar is unrestricted so that said container is unlocked and may be opened.

15. The linkage mechanism defined in claim 14 further including means for maintaining said safety mechanism in said first position to maintain said container in a closed configuration.

16. The linkage mechanism defined in claim 15 wherein said means for keeping said safety mechanism in said first position comprises a spring.

17. The linkage mechanism defined in claim 14 wherein:

said vertical bar has a first and a second end;

said vertical bar is pivotally linked at said first end to said horizontal bar;

said vertical bar is pivotally linked at said second end to said lid; and depressing said horizontal bar causes said vertical bar to move said lid to open said receptacle.

18. The linkage mechanism defined in claim 17 wherein said safety mechanism is positioned on said horizontal bar to prevent downward movement of said horizontal bar and thereby maintain said container in a closed configuration.

19. The linkage mechanism defined in claim 18 wherein:

said safety mechanism comprises an oblong member having a center, said oblong member being pivotally and rotatably connected to said horizontal member adjacent the center of said oblong member;

said oblong member is in a substantially vertical position when said safety mechanism is in said first position; and said oblong member is in a substantially horizontal position when said safety mechanism is in said second position.

20. The linkage mechanism defined in claim 19 further including a spring for maintaining said oblong member in said substantially vertical position.

21. The linkage mechanism defined in claim 20 further including means for preventing overrotation of said oblong member by forces exerted by said spring, said means for preventing overrotation functioning with said spring to maintain said oblong member in said substantially vertical position.

22. The linkage mechanism defined in claim 19 wherein said oblong member has a first lower end and a second upper end.

23. The linkage mechanism defined in claim 22 further including a foot pad on said horizontal member adjacent said safety mechanism, wherein said second upper end of said oblong member is positioned above said foot pad when rotated into said horizontal configuration, such that said receptacle is opened by stepping on said second upper end of said oblong member, rotating said oblong member to said substantially horizontal configuration, and depressing both said oblong member and said horizontal bar.

* * * * *